US006688930B2

(12) United States Patent
Cottrell et al.

(10) Patent No.: US 6,688,930 B2
(45) Date of Patent: Feb. 10, 2004

(54) HYBRID BUOYANT RISER/TENSION MOORING SYSTEM

(75) Inventors: Roy H. Cottrell, Cypress, TX (US); Martin Duensing, Cypress, TX (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 10/154,363

(22) Filed: May 22, 2002

(65) Prior Publication Data

US 2002/0177375 A1 Nov. 28, 2002

Related U.S. Application Data

(60) Provisional application No. 60/293,010, filed on May 22, 2001, and provisional application No. 60/297,722, filed on Jun. 12, 2001.

(51) Int. Cl.[7] ..... B63B 22/02
(52) U.S. Cl. ..... 441/5; 441/133
(58) Field of Search ..... 441/4, 5, 133; 166/350

(56) References Cited

U.S. PATENT DOCUMENTS

| | | | | |
|---|---|---|---|---|
| 4,065,822 | A | 1/1978 | Wilbourn | |
| 4,173,804 | A | 11/1979 | Duc | |
| 4,176,986 | A | 12/1979 | Taft et al. | |
| 4,320,545 | A | 3/1982 | Pomonik | |
| 4,490,121 | A | 12/1984 | Coppens et al. | 441/5 |
| 4,568,295 | A | 2/1986 | Poldervaart | 441/3 |
| 4,637,335 | A | 1/1987 | Pollack | |
| 5,564,957 | A | 10/1996 | Breivik et al. | 441/5 |
| 5,927,224 | A | 7/1999 | Etheridge et al. | 114/230.1 |

FOREIGN PATENT DOCUMENTS

| | | |
|---|---|---|
| EP | 0 796 784 A1 | 9/1997 |
| WO | WO 97/00806 | 1/1997 |
| WO | WO 99/57413 | 11/1999 |

*Primary Examiner*—Jesus D. Sotelo
(74) *Attorney, Agent, or Firm*—Gary L. Bush; Andrews Kurth LLP

(57) ABSTRACT

A buoyant hybrid riser/tension (BHRT) member moors a floating body on the sea surface to a pipeline terminated at a submerged structure. The BHRT includes one or more conduits, one or more tension members, and buoyancy. The conduits provide fluid communication from the pipeline at the submerged structure the tension member absorbs the mooring load and the buoyancy cooperates with the tension member to produce a soft restoring force for mooring the floating body to the submerged structure. The BHRT lower end connection allows angular, but not torsional displacement with respect to the submerged structure. In one arrangement of the BHRT lower end, localized flexing is allowed in the separate conductors via bend stiffeners. At the BHRT upper end, several arrangements for the connection between the BHRT and floating body are provided. In one arrangement, a rigid connection is established between a male coupler at an upper end of the BHRT and a female coupler on the floating body. In a second arrangement, the upper end of the BHRT includes a riser end buoy with a mating surface that connects with a female receptacle mounted on a bearing assembly on the floating body. On top of the female receptacle is an ESD valve block and a swivel (in one arrangement) or a manifold block (in another arrangement). The BHRT can "wind up" in torsion when the floating body weathervaning. Such wind up can be undone by temporarily releasing a brake which normally secures the female coupling to the floating vessel and allowing the BHRT and female coupling to rotate backward with respect to the floating vessel.

52 Claims, 8 Drawing Sheets

30

S
B
B
B
B
10
2
2
θ
20
7

90
60
70
80
10

90
60
80
80
10
70
60

80
10
90
60
70
80
80

FIG. 5
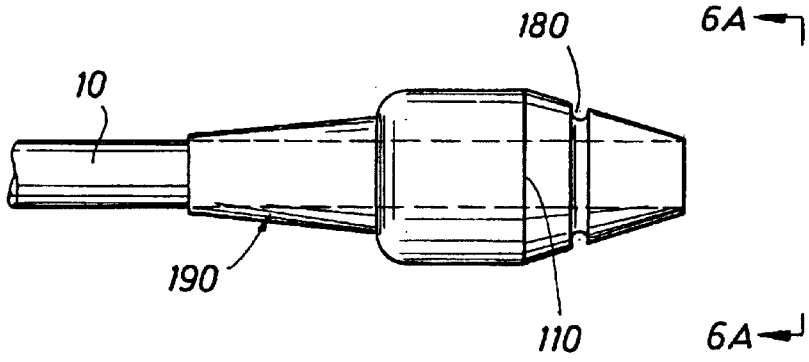
FIG. 6A
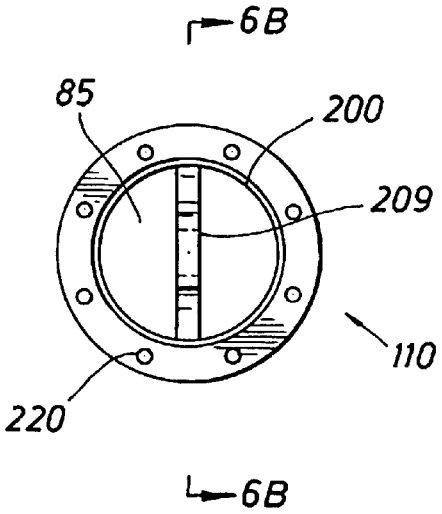
FIG. 6B
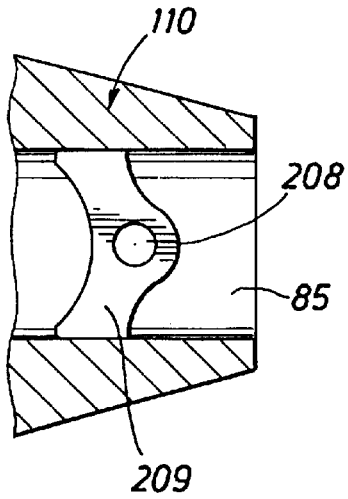
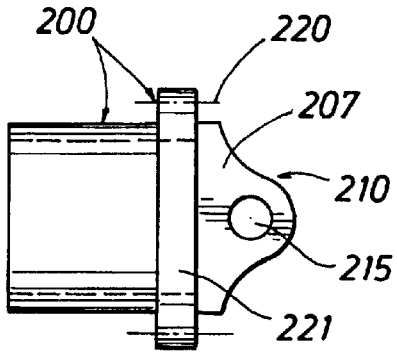
FIG. 7

FIG. 10B
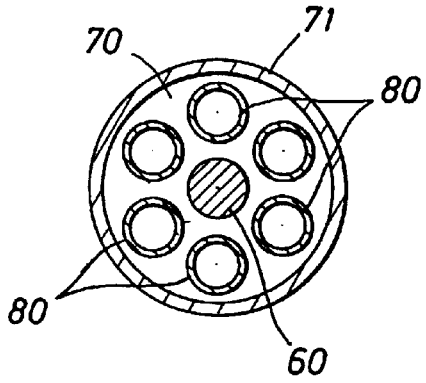
FIG. 10C
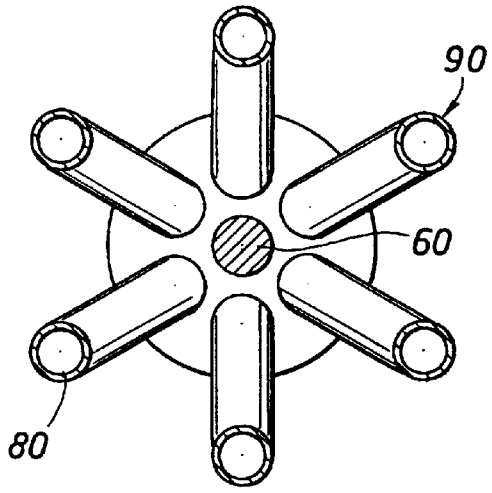
FIG. 11A
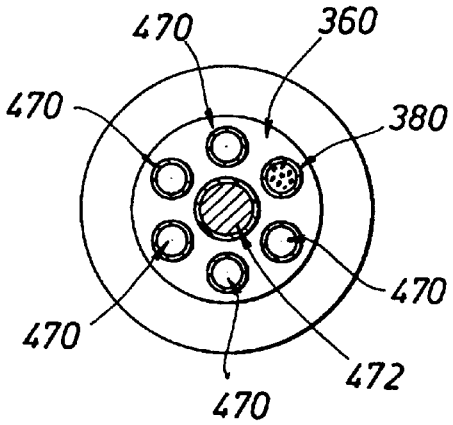
FIG. 11B
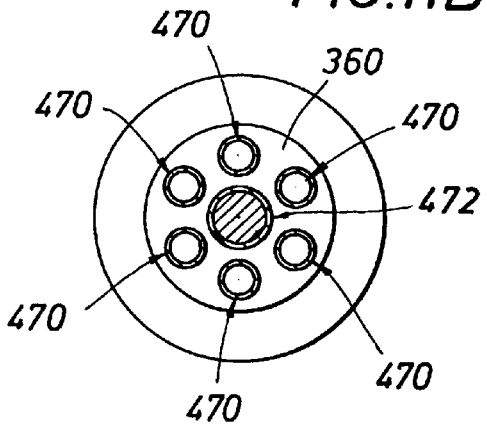
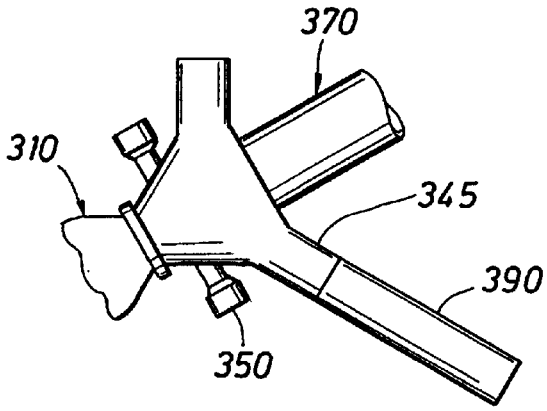
FIG. 14

HYBRID BUOYANT RISER/TENSION MOORING SYSTEM

CROSS REFERENCE TO RELATED APPLICATION

This application claims priority from provisional application No. 60/293,010 filed May 22, 2001 and provisional application No. 60/297,722 filed Jun. 12, 2001.

BACKGROUND OF THE INVENTION

1. Field of the Invention

This invention relates generally to a mooring system for floating storage vessels and particularly to a single point mooring system which includes a fluid flow path from a subsea structure to a vessel for mooring the vessel and loading hydrocarbons thereon or discharging hydrocarbons from the vessel to the subsea structure.

2. Description of the Prior Art

European patent application publication EP 0 796 784 A1 shows a gimbal or swivel mounted on a base at the sea floor for connection of separate mooring lines and a flexible hose (riser). A rotation collar connects the mooring line to the base.

International patent application publication number WO 99/57413 discloses a composite hybrid riser having a central tension member surrounded by a plurality of fluid transmitting tubes.

U.S. Pat. No. 5,927,224 shows a turret moored system anchored by dual function riser/mooring lines. Each hybrid line includes an outer cylindrical shell which serves as a tension member. One or more conduits inside the outer shell serve as fluid conduits between the vessel and a subsea manifold.

3. Identification of Objects of the Invention

A principal object of the invention is to provide an improved single point mooring system for mooring and fluid transfer between a submerged structure and a floating body which utilizes a buoyant hybrid fluid conductor/tension member as the anchor leg and the fluid flow path.

Another object of the invention is to provide a disconnectable mooring system by which a vessel or other floating body is moored about a single point by means of a buoyant hybrid riser tension member arrangement.

Another object of the invention is to provide a buoyant hybrid fluid conductor/tension member having a fluid conduction path, a tension member and buoyancy material along the length of the member, so that a single member, having a length that reaches from a subsea structure to a vessel, serves as a conduit for the transfer of hydrocarbon fluids and serves as a single anchor leg with restoring force.

Another object of the invention is to provide a buoyant hybrid fluid conductor/tension member which is rigidly connected to a submerged structure and to a floating body where the member twists as the vessel weathervanes about the submerged structure.

Still another object of the invention is to provide a buoyant hybrid fluid conductor/tension member which alternatively includes a load transferring rotatable fluid connection between a submerged structure and a floating member.

SUMMARY

The objects identified above, along with other features and advantages of the invention are incorporated in a mooring system where a buoyant hybrid riser/tension arrangement (BHRT) moors and fluidly couples a floating body on the sea surface to a subsea structure such as pipeline end manifold (PLEM) at the sea floor, a submerged tower, a submerged TLP structure or a submerged buoy. The floating body may be a dedicated shuttle tank, shuttle tanker of opportunity or a Floating Storage and Offloading vessel (FSO) or a Floating Production Storage and Offloading vessel (FPSO). The BHRT includes one or more conduits, buoyancy members and tension members. The tension members may be the walls of tubular conduits or a separate tension device such as a stranded wire cable. The conduits establish one or more fluid flow paths between the submerged structure and the floating body. The tension members and buoyancy members allow the floating body to weathervane about the submerged structure, while keeping the floating body on station, utilizing tensile anchoring and buoyancy of the BHRT, to produce a soft restoring force.

A coupling of the BHRT to the submerged structure allows angular, but not torsional displacement of the lower end of the BHRT. In one embodiment of the BHRT lower end, localized flexing is provided in the separate conduits via bend stiffeners. At the BHRT upper end, several embodiments of a BHRT/Floating body coupling are provided. In a first embodiment, a rigid connection is established between a male coupler at the upper end of the BHRT and female coupler on the floating body. All torsional displacement occurs along the length of the BHRT between the subsea structure and the floating body. In a second embodiment, the upper end of the BHRT includes a riser end buoy with a mating surface that couples with a female receptacle mounted on a bearing assembly on the floating body. On top of the female receptacle is an ESD valve block and a swivel (in a first embodiment) or a manifold block (in an alternative embodiment).

In another embodiment, a load transferring rotatable fluid connection or swivel is provided in the BHRT between the submerged structure and a floating member.

BRIEF DESCRIPTION OF THE DRAWINGS

The invention is described in detail hereinafter on the basis of the embodiments represented schematically on the drawings of the accompanying figures, together with the clarification of further details and characteristics, in which respect it should be noted that any variations in the relative positions of the elements and the consequent simplifications which may derive therefrom are to be considered as falling within the claims attached hereto as constructional modifications included in the general idea. On the accompanying drawings:

FIG. 5 illustrates a coupler attached to the BHRT upper end for connection to a floating body;

FIG. 6A is a cross section of the coupler of FIG. 5 taken along section lines 6A—6A;

FIG. 6B is a cross section of the coupler of FIG. 5 taken along section lines 6B—6B of FIG. 6A;

FIG. 7 is an illustration of an alternative pull-in adapter to that shown in FIG. 6A;

FIGS. 11A and 11B show alternatives to the pull-in line of FIG. 10 with a radial cross-section along lines 11—11 of FIG. 10;

FIG. 14 is an illustration of pig launcher/receiver ESD Valve Manifold Block.

DESCRIPTION OF THE PREFERRED EMBODIMENT OF THE INVENTION

Figures 1, 2, 2A, 2B, 4A, 4B:
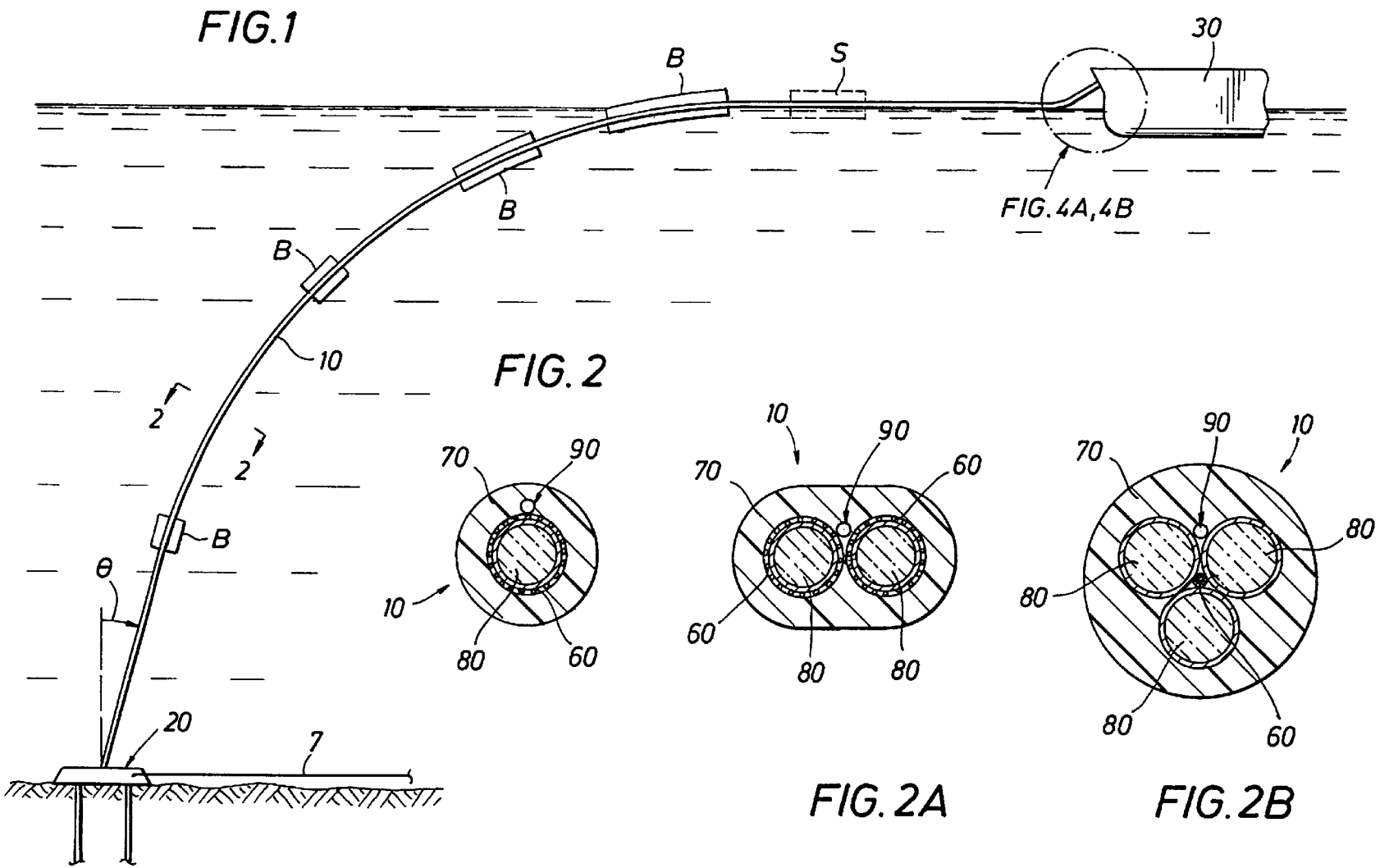
FIG. 1 illustrates a BHRT which moors a floating body to the seabed and fluidly couples the floating body to a submerged structure such as a PLEM.
FIGS. 2, 2A, and 2B are alternative designs of a BHRT arrangements with illustration of radial cross sections taken along lines 2—2 through the BHRT member of FIG. 1.
FIG. 4A illustrates a coupling arrangement of the BHRT member to a floating body with connection and disconnection steps described.
FIG. 4B illustrates an alternative coupling arrangement to a floating body.

FIG. 1 illustrates a first embodiment of the invention, where a Buoyant Hybrid Riser/Tension Member 10 (called here a "BHRT" member) flexibly couples a floating body 30 to a submerged structure such as a PipeLine End Manifold 20 (called here a "PLEM 20"). Such a submerged structure could be a PLEM as used in the illustrations below, but such structure could alternatively take the form of a submerged tower, a submerged TLP, a submerged buoy, etc. In all of such structures, a pipeline or pipelines is terminated at the structure and must be fluidly connected to a floating body such as a vessel. In FIG. 1, the floating body 30 can be a FPSO, shuttle tanker, or the like and the PLEM 20 can be affixed to the sea floor by one of many known methods in the art, including gravity, driven piles, suction piles and the like. The cross section of the BHRT 10 is in the shape of a noodle (see FIG. 2), and is not only capable of transferring mooring loads along its length, but is also arranged and designed for fluid transfer and buoyancy. The transfer of mooring loads allows the BHRT 10 to moor the floating body 30 about a single point on the seafloor or to any submerged structure as identified above via connection with the submerged structure. These mooring forces work in conjunction with the buoyancy of the BHRT 10 to provide a restoring force for keeping the floating body 30 on station with respect to PLEM 20 or other submerged structure while still permitting the floating body 30 to weathervane. The connection of the BHRT 10 to the PLEM 20 or other submerged structure is through a flexible coupling (see the coupling arrangement 260 of FIGS. 8 and 9) which is axially stiff but angularly soft. In other words, as the floating body 30 weathervanes about the PLEM 20 or other submerged structure, the BHRT 10 is arranged and designed to deflect in the direction of the applied mooring load without damaging the BHRT 10.

The connection of the BHRT 10 at the sea floor or a subsea structure does not require a swivel. A direct connection is required between flow line 7 and BHRT 10. A no-swivel connection at the sea floor is a distinct advantage, because swivels located on the sea floor are difficult and costly to service. Weathervaning is accommodated through angular deflection of the BHRT 10 along the entire length of the BHRT 10 in torsion only. When the BHRT 10 is used in conjunction with a floating body 30 such as a dedicated shuttle tanker 30A or a shuttle tanker of opportunity 30B (See FIGS. 3A, 3B), loading or unloading should be accomplished in 24 hours or less. Due to such a short duration of connection, windup of torsion built up in the BHRP 10 may be limited, and no swivel may be necessary at all between the submerged structure and the vessel via the BHRP 10. In other words, the BHRT includes a disconnectable "noodle" mooring system in which relatively quick connection and disconnection is possible between BHRT 10 and a vessel 30, and no swivel is provided.

Nevertheless, a swivel may be required for the arrangement of FIG. 1 when mooring and fluid transfer is required with a connection in place for a relatively long period of time and where substantial weathervaning angles may result. Thus a swivel S may be provided at any point along the BHRT 10 length, preferably at the water surface for ease of maintenance and repair. Such a swivel S, schematically illustrated in BHRT 10 of FIG. 1, is arranged and designed for load bearing.

Figure 1A:
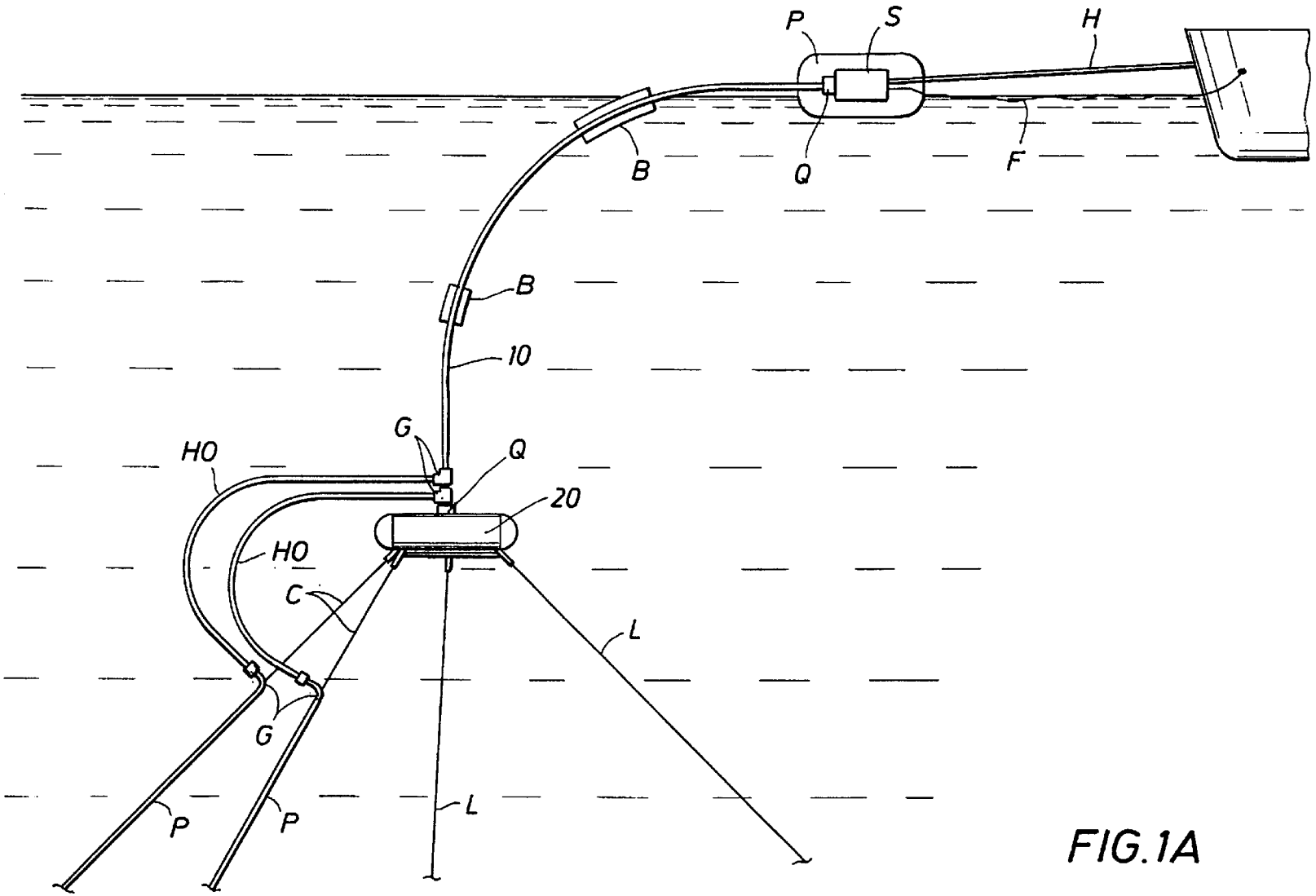
FIG. 1A illustrates an alternative arrangement where the submerged structure is a submerged flow line termination buoy with a steel pipeline for carrying hydrocarbon to it and with a BHRT secured to said termination buoy and to a floating body on which a swivel is mounted, with a vessel connected to the floating body by a hawser and flow lines.

FIG. 1A illustrates an alternative arrangement to that of FIG. 1 where a load bearing swivel 5 is mounted on a floating body such as a pontoon structure P. A vessel is moored by means of a hawser H to the swivel with flow lines F rotatably coupled via swivel S to conductor of BHRT 10.

The submerged structure 20 of FIG. 1A is a submerged buoy tethered to the sea floor by lines L. Such a submerged structure is illustrated and described in co-pending U.S. application Ser. No. 09/659,495 filed on Sep. 9, 2000, now U.S. Pat. No. 6,415,828 which is incorporated herein. Pipeline(s) P (for example from a production platform) have their ends carried by flexible tension members C which preferably are lengths of chains. Flexible hoses HO are connected to gooseneck members G at the ends of pipelines P and at the end of the BHRT 10. Bend stiffeners Q assure that a stiff connection occurs at the connection point between the bottom of the BHRT 10 and the submerged buoy 20 and at the top of the BHRT 10 to the swivel S. Alternatively, BHRT 10 may be connected to a gooseneck which in turn is connected by chain to submerged buoy 20.

The arrangement of FIG. 1A advantageously replaces a calm buoy of the above mentioned Ser. No. 09/659,495 with a BHRT 10 and a load bearing rotatable swivel on a pontoon or other floating structure, with resultant decreases in weight and cost.

FIGS. 2, 2A, and 2B illustrate alternative embodiments of a BHRT 10 according to the invention. FIGS. 2, 2A, and 2B illustrate cross sections, taken at lines 2—2 of FIG. 1 of the invention. The BHRT 10 includes one or more tensile members 60, buoyancy material 70, and one or more conductors 80 and/or umbilicals 90. The tensile members of FIGS. 2 and 2A are the structural tube walls of the conductors 80. In other words, the conduits 80 serve to conduct hydrocarbons and simultaneously act as strength members to anchor the vessel 30 to the submerged structure 20. The tension members 60 transfer the mooring loads along the entire length of a BHRT 10, from the floating body to the submerged structure 20. The buoyancy material 70 provides an upward buoyant force to the BHRT 10 and can be placed either continuously or intermittently along the length of the BHRT 10 in any distribution according to engineering design for water depth, vessel size and other conditions. The buoyancy material 70 can advantageously be placed strategically along the length of BHRT 10 to optimize performance and minimize costs. Auxiliary buoyancy members B are schematically illustrated on BHRT 10 in FIG. 1 to show that the buoyancy can be placed to optimize the mooring characteristics of the BHRT 10. The conductors 80 function as fluid flow paths which can be used to conduct hydrocarbon fluids (gas and fluids) and the like. An umbilical 90 conducts pressured fluid from the floating buoy 30 via the BHRT 10 to the submerged structure 20. The umbilical 90 (only one is illustrated, but plural umbilicals can be provided) may be used to conduct pressurized control fluid to open valves (not shown) on the submerged structure 20 and in wells connected to pipeline 7 for example. The umbilical 90 can also carry an electrical or optical conductor for SMART well service, etc. The umbilical can also be used to inject chemicals into a well via a connecting umbilical in a pipeline to a well. When a floating body 30 such as a shuttle tanker disconnects, the source of pressure is removed, which allows valves on the submerged structure 20 to automatically close. Similarly, if the conductor 80 separates or is severed anywhere from the submerged structure 20 to the vessel, the submerged 20 body is arranged and designed for automatic closure of the fluid flow path to conduit 80, providing a fail safe system.

Figure 3A:
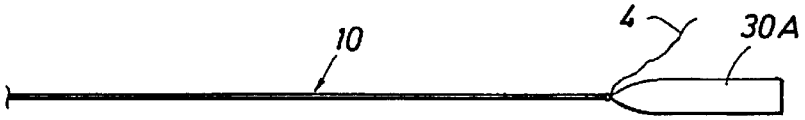
FIGS. 3A, 3B, and 3C illustrate that the BHRT member can be connected to a dedicated shuttle tanker or to a shuttle tanker of opportunity or can be floating on the surface of the water waiting for connection to a vessel.
Figure 3B:
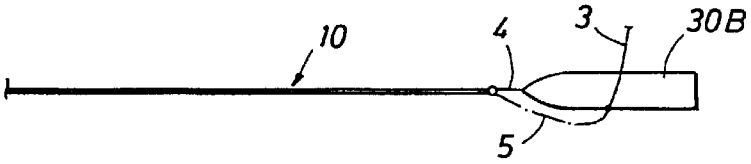
Figure 3C:
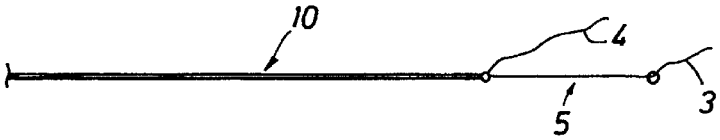
Figure 4A:
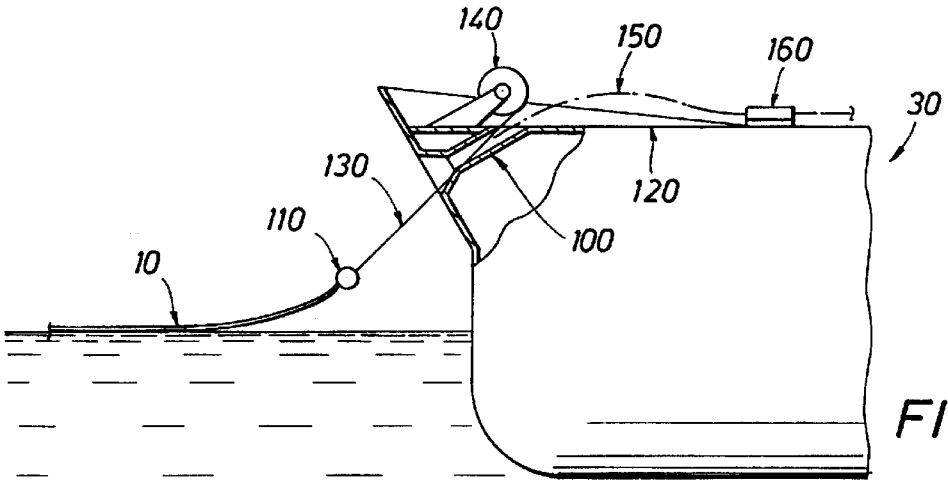
Figure 4B:
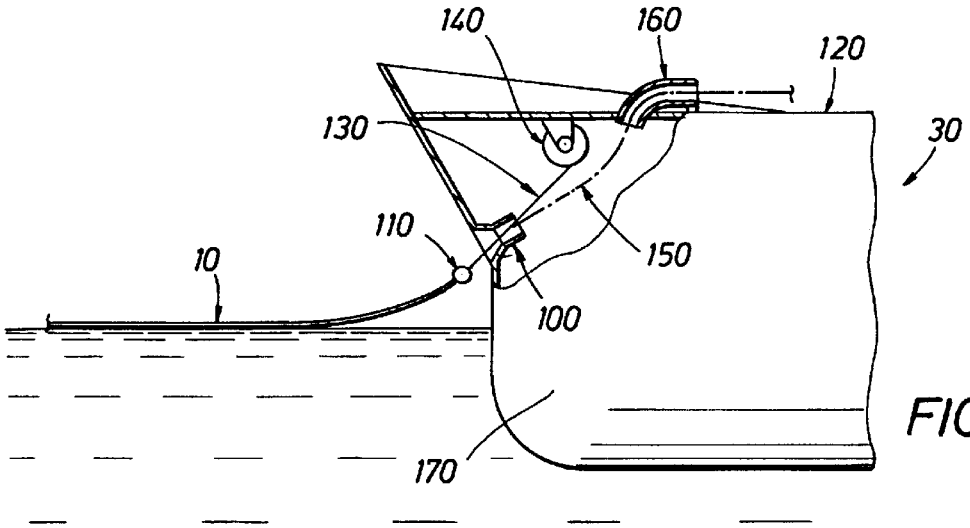

FIGS. 3A, 3B and 3C illustrate schematically how a BHRT 10 can be connected to a dedicated shuttle tanker 30A on a shuttle tanker of opportunity 30B. Dedicated shuttle tankers, for the purpose of this designation, are those arranged for direct coupling to the surface end of the BHRT 10. Such dedicated tankers are illustrated for example in FIGS. 4A and 4B as described below. Shuttle tankers of opportunity are those that must be moored by means of a hawser and coupled by a conventional floating hose over the side of the vessel. FIG. 3C illustrates a BHRT 10 with its surface end floating on the surface of the water prior to connection to a shuttle tanker. A pull in line 3 is secured to the end of a floating hose or hoses 5 which are fluidly connected to the conduits of the BHRT 10. A mooring hawser 4 is connected to the tension member of the BHRT 10 at its floating end. FIG. 3B shows connection of the BHRT 10 to a shuttle tanker of opportunity 30B with the floating hose 5 connected to the side of the vessel and the hawser 4 connecting vessel 30B to the tension member of the BHRT 10. FIG. 3A shows the BHRT 10 connected to a dedicated tanker 30A where the hawser 4 and the extension hoses 5 have been pulled through a coupling on the vessel 30A; the hawser 4 is not needed.

As described above, buoyancy material 70 is distributed along the length of the flexible BHRT 10. When mooring load increases as the vessel moves away from the submerged structure, more of the buoyancy material 70 becomes submerged, because the angle of rotation from vertical increases at the base (See FIG. 1). This feature results in a very soft mooring system which produces lower peak loads than a CALM moored system.

While a traditional CALM system can be connected in sea states up to Hs=4.5 m, the disconnectable transfer system of FIG. 1 can be connected in sea states up to Hs=5.5 m, thereby providing a greater window of opportunity for loading and unloading. The arrangement of FIG. 1 provides lower peak loads and very little inertia at the surface end of the BHRT 10 when compared to a disconnectable system such as shown in U.S. Pat. No. 5,240,446 for example. As a consequence, handling the hose end is easier and safer than the case with either a CALM connection or a submerged turret loading in still higher sea states.

When the terminal is unoccupied as in FIG. 3C, the BHRT 10 streams out to align with the direction of prevailing wind and surface waves. The survivability of the system compares favorably to a CALM or SALM system due to the small area presented to wind and waves.

As compared to alternative mooring systems, the arrangement of FIG. 1 provides a more direct load path, greater utilization, fewer moving parts and less impact on the vessel served. It also provides a softer mooring system, with greater flexibility to quickly and efficiently service dedicated shuttle tankers 30A as in FIG. 3A or shuttle tankers of opportunity 30B as in FIG. 3B.

For dedicated shuttle tankers 30A, the arrangement of FIG. 1 provides a number of advantages when compared to a submerged turret loading system. A few of the advantages are listed below, but other advantages may occur to the industry that are not listed here.

1. Possible connection on deck in open air, as shown in FIG. 4A as illustrated below.
2. Less invasive hull modifications, as shown in FIG. 4B below.
3. No impact on cargo carrying capacity of the vessel.
4. Ease of pull in line transfer to pull in winch for deck mounted version.
5. Rapid connection and disconnection.
6. No need for a fluid swivel or surface accessible swivel.
7. No swivel space, no need for deballasting swivel space and no need for ventilating or inerting swivel space if the arrangement of FIG. 4A is adopted.
8. Possibility of providing a load bearing fluid swivel at or about the waterline so that accessibility for maintenance and installation is provided.

FIGS. 4A and 4B illustrate alternative representative embodiments for connection of the BHRT 10 with the floating body 30 in which no swivel is required. FIG. 4A shows floating body 30 mounted with a female coupler 100, which directly communicates with deck level 120. The female coupler 100 is arranged and designed to accept insertion of the male coupler 110 (shown, for example in FIG. 5) attached to the end of the BHRT 10. To facilitate the connection of the male coupler 100 and female coupler 110, a pull in line 130 is releasably connected to the male connector or permanently attached thereon. In operation, a line (not shown) from the floating body 30 is connected to the pull in line 130, and a winch 140 or the like is used to "pull in" the male coupler 110 to the female receptacle 100. When the male coupler 110 is in place within the female receptacle 100, a device such as an actuated locking mechanism (not shown) is activated to lock the male coupler 110 in place. Actuated dogs which register with groove 180 are an example of a locking arrangement. After such locking, loading hoses or removable pipe pieces 150 are arrayed to establish communication from conduit 80 of the BHRT 10 to the fixed cargo piping 160 on the floating body 30. After the connection of the BHRT 10 to the vessel 30 is made, valves on the submerged structure 20 (not shown) are opened to establish hydrocarbon flow from pipeline 7. FIG. 4B operates in a similar manner, except that the female coupler 100 is connected through the hull 170 of the floating body 30.

FIG. 5 illustrates the male coupler 110 of FIGS. 4A, 4B. An internal seal 200 (see FIG. 6A) of the coupler 110 presses against a shoulder of female coupler 100 to prevent fluid leakage. A locking groove 180 is arranged and designed to accept an actuated locking mechanism of the female coupler (not shown) to lock the male coupler 110 in place. The bend restricter 190 is preferably manufactured of an elastomeric material allowing bending of up to thirty degrees. Additionally, the male coupler 110 is provided with a bend restrictor 190 at the male coupler 110/BHRT 10 interface.

FIG. 6A shows a radial cross section of the male coupler 110 when viewed along lines 6A—6A of FIG. 5. A fluid conductor passage 85 extends longitudinally through the male coupler 110. As mentioned above, the internal seal 200 in cooperation with a shoulder of female coupler 100 provides leak free communication between the male coupler 110 and loading hoses or removable pipe pieces 150 (see FIGS. 4A and 4B). A bolt circle 220 extends around an outer flange of male coupler 110, which facilitates the connection of a pull in adapter (not shown) with the male coupler 110. Lying within the conductor 85 is a traverse member 209, which has a hole through which an end of pull-in line 130 can be secured. FIG. 6B shows an axial cross section of coupler 110 viewed along lines 6B—6B.

FIG. 7 illustrates an alternative arrangement 210 of the end of male coupler 110 of FIG. 5. A member 207 having a hole 215 is provided for securing an end of a pull-in line 130. Holes 220 around a flange 221 are provided for connection of a pull-in adapter (again, not shown). Body 200 of the adapter is secured within the body of the male coupler 110.

Figures 8, 9:
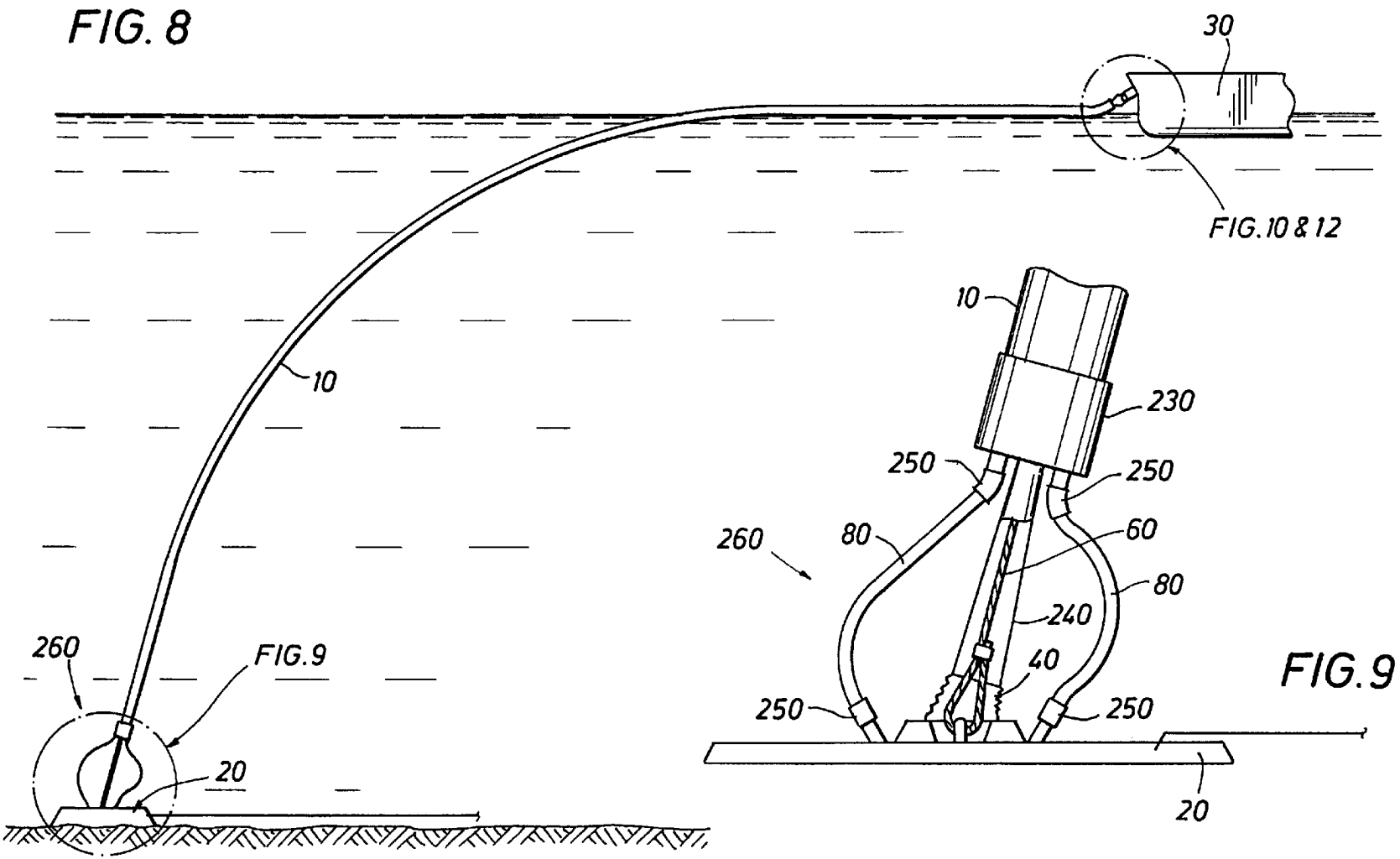
FIG. 8 illustrates an alternative embodiment of the BHRT of FIG. 2.
FIG. 9 illustrates details of the connection of the BHRT of FIG. 8 to a submerged structure such as a PLEM at the sea floor.

FIG. 8 is an alternative embodiment of the invention from the embodiment of FIG. 1. As mentioned above, a floating body 30, such as an FPSO, shuttle tanker, or the like can be moored about a single point on the sea floor by means of the BHRT 10. In the embodiment of FIG. 8, the BHRT 10 has multiple conduits or conductors 80 (see FIG. 9) which permit subsea production from multiple pipelines from multiple wells, for example. As shown in FIG. 8, the BHRT 10 is flexibly attached to the sea floor through a PLEM 20 or other submerged structure fixed or tethered or anchored to the sea floor. The buoyancy of BHRT 10 provides a restoring force to keep the FPSO 30 on station while it is permitted to weathervane. As mentioned above, a PLEM 20 is illustrated, but it is mainly representative of any one of a plurality of submerged structures to which a pipeline extends. A submerged tower, a submerged TLP, a submerged buoy are all examples of such a submerged structure.

In FIG. 9, details of the BHRT 10/PLEM 20 connection of FIG. 8 are shown. At the BHRT lower end 260, the BHRT 10 is dead ended into a riser end housing 230. At the riser end housing 230, a tension member 60 such as a stranded steel wire, passes through and couples to a lower flexible torque shaft 240. The tension member is preferably a cable formed of stranded steel wire, but other strong flexible materials could be used. The lower flexible torque shaft 240 and tension member 60 are coupled to the PLEM 20. The lower flexible torque shaft 240 at its lower end includes flex member 40. The lower flexible torque shaft 240 (including flex member 40) functions in a manner similar to the embodiment of FIG. 1 by permitting angular distortion from the vertical without angular distortion about the longitudinal axis of member 10. Each "riser" or conductor 80, as shown in this embodiment, is separately connected to the PLEM 20, which as mentioned above, allows multiple subsea well connections. The portion of each conductor 80 between the PLEM 20 and rigid housing 230 is splayed outwardly via bend stiffeners 250 to permit localized flexing in the conductors 80.

Figures 10, 10A:
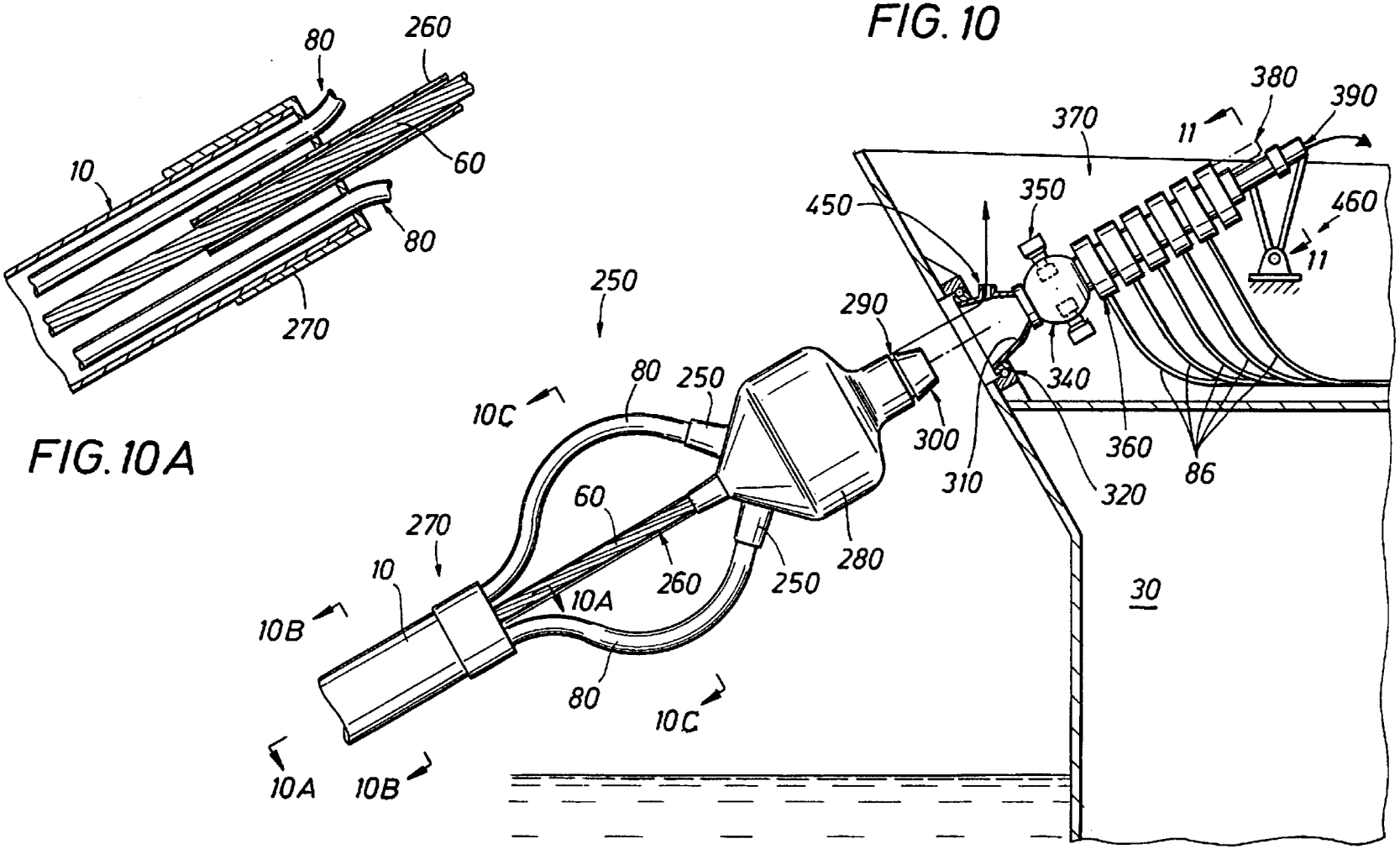
FIG. 10 illustrates in a side view details of the connection of the BHRT member to a vessel such as a FPSO or tanker, with FIG. 10A being an axial cross-section of the riser end housing at the top end of the BHRT member, FIG. 10B showing a radial cross-section along lines 10B—10B of FIG. 10 and FIG. 10C showing a radial cross-section along lines 10C—10C of FIG. 10.

FIG. 10 shows details of the BHRT upper end 250 of FIG. 8. The BHRT 10 is dead ended into a riser end housing 270 (see the detail of FIG. 10A). At the riser end housing 270, the tension member 60 extends through and couples with an upper flexible torque shaft 260, which is flexible in bending but rigid in torsion. The flexible torque shaft 260 and tension member 60 are secured to a riser end buoy 280. Each conductor 80, as shown in this embodiment, is separately connected to the riser end buoy 280. The portion of each conductor 80 between the riser end housing 270 and riser end buoy 280 is splayed outwardly via bend stiffeners 250 to permit localized flexing in the conductors 80. Alternatively, each conductor 80 can terminate in a flange (not shown) and a flexible replaceable conductor (not shown) can complete the fluid path between the riser end housing 270 and the riser end buoy 280. The upper flexible torque shaft 260 and tensile member 60 transmit tensile forces, and allow the conductors 80 to adopt a natural drape without overstressing, both during and after a connection with the riser end buoy 280.

FIG. 10B illustrates the tension member 60 and conductors 80 in a radial cross-section through lines 10B—10B of BHRT 10. While the term "conductor" is used herein, one or more of the conductors or conduits or risers could be used as an umbilical 90 (an umbilical 90 is described by reference to FIGS. 2, 2A, and 2B). The tension member 60 and conductors 80 are surrounded by buoyancy material 70, which as described with reference to FIG. 2, can be placed either continuously or intermittently, along the length of the BHRT 10. An outer sheath 71 is also provided. Another cross-section view, that of FIG. 10C, is taken along lines 10C—10C in FIG. 10, showing the conductors 80 and tensile member 60.

The riser end buoy 280 is designed with a locking groove 290 and mating surface 300 which connects to a female receptacle 310 located on the bow of the floating body 30. Such connection can be one of many male/female locking mechanisms known to routineers in the mooring system art, including, but not limited to a system as described above with reference to FIGS. 4A, 4B, 5, 6, 7. The female receptacle 310 is mounted on a bearing assembly 320. Alternatively, the bearing assembly 320 can be mounted flexibly or on gimbals, depending on the amount of motion to be shared between the BHRT 10 and the female receptacle 310. Coupled to the female receptacle 310 is an ESD valve block 340 with actuators 350 and accumulators (not shown), which can be released for valve closing through signals sent through either swivel 380 or radio telemetry.

Mounted to the ESD valve block 340 is a swivel core 360 of swivel 370. The swivel core 360 allows the longitudinal passage of pigs (not shown) and a pull-in line, if so desired. FIGS. 4A, 4B show a pull-in line 130. In the event that a pull-in line is passed through the swivel core 360, an eccentric utility swivel 380 is provided an arrangement as illustrated in FIG. 11A. Alternatively as shown in FIG. 11B, the umbilical core can be centrally located with pull-in accomplished through one of the radial passages. If all passages in the core are used for fluid conduction or umbilicals, pull-in can be accomplished through the wall 450 of the female receptacle 310. One or more conduits 86 extend from the swivel 370 and lead to vessel storage holds. Conduits 86 can be flexible.

A pig launcher/pig receiver 390 is mounted on a hinged assembly 460 as illustrated in FIG. 10 for quick coupling to the top end of the swivel 370. When not pigging, quick connect flanges 470 (see FIGS. 11A and 11B) are installed to renew the integrity of the passages of the swivel core 360 to permit production.

As mentioned above, FIG. 11A shows a cross-section taken along lines 11—11 of FIG. 10 where the internal core 360 of the swivel 370 is shown. The internal core 360 of the swivel is fixed with the end 280 of BHRT 10, while the floating body 30 rotates with respect to it during weathervaning. A pull-in passage core 472 may be provided and a utility swivel passage 380 may be provided in addition to the passages 470 for connection to the conduits 80 of the BHRT 10. Alternatively, the central passage 472 may be used as the umbilical passage and one of the other passages 470 used for the pull-in line as shown in FIG. 11B.

Figures 12, 13:
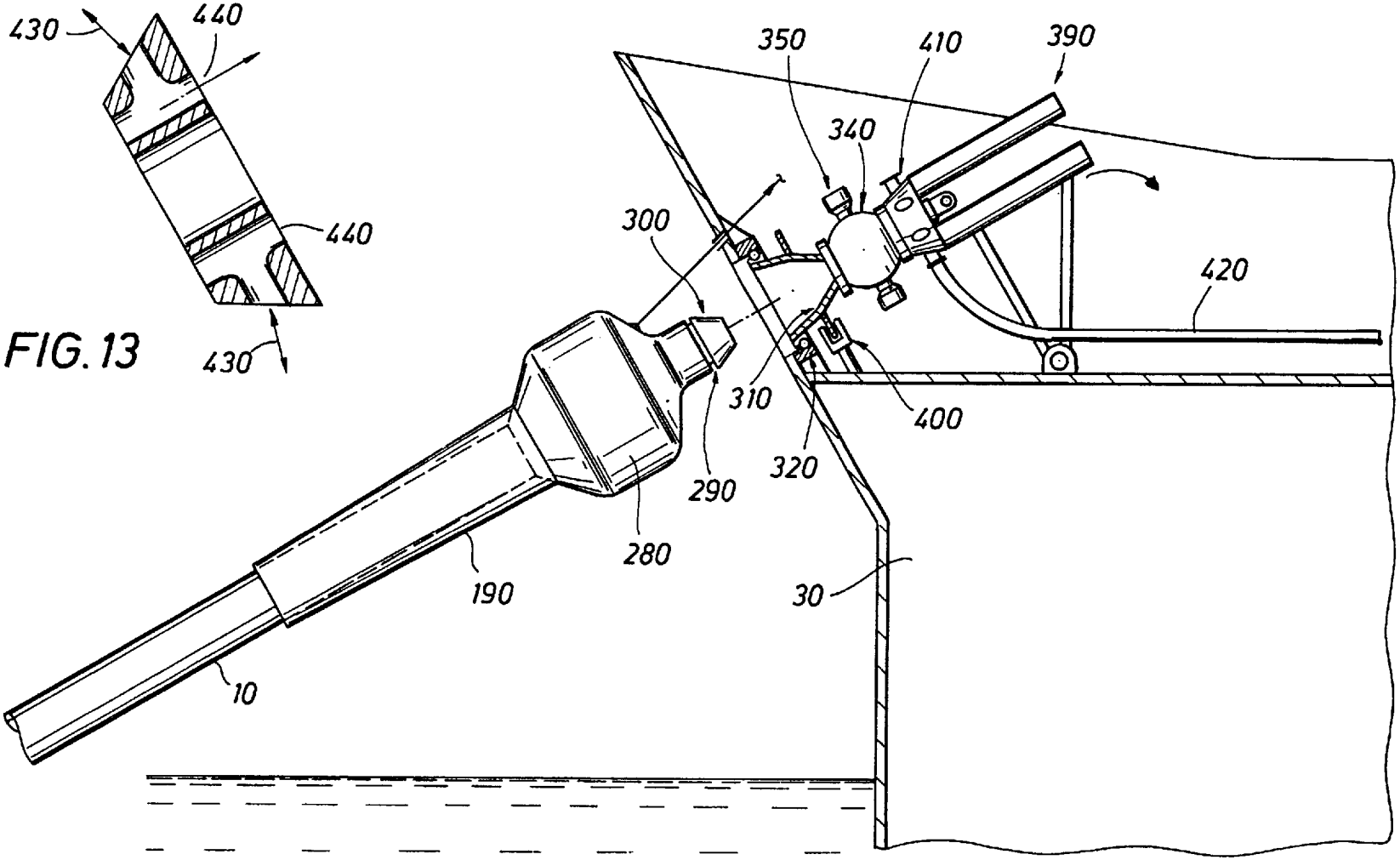
FIG. 12 shows an alternative arrangement to that of FIG. 10 where a riser windup device is provided for weathervaning.
FIG. 13 is an enlarged cross-section of the manifold block of FIG. 12.

FIG. 12 shows an alternative arrangement of the invention from that of FIG. 10 where a manifold block 410 is provided instead of a swivel 370 (FIG. 10). The manifold block 410 is coupled to the ESD valve block 340 and pig launchers/pig receivers 390 are coupled to the manifold block 410. One or more flexible conductors 420 are coupled to the sides of the manifold block 410. Weathervaning of the vessel 30 depends on the windup of the BHRT 10.

In a manner similar to the embodiment of FIG. 5, the BHRT 10/riser end buoy 280 is retrofitted with a bend restrictor 190. The riser end buoy 280 is mated with the bearing mounted female receptacle 310; however, a disc brake 400 is selectively applied to prevent rotation of the female receptacle 310, ESD Valve Block 340 and pig launcher/pig receiver 390. In other words, during normal operation, the brake 400 is activated, with the result that the female coupler 310, riser end buoy 280 and vessel 30 are coupled together through the brake 400. As the floating body 30 weathervanes and several cycles are lapped in the same direction of rotation, the BHRT 10 will twist or "wind up." At a prudent opportunity, the isolation valves 350 are closed, thereby isolating system pressure within the hybrid risers to the manifold block 410, and pig launchers/pig receivers 390 are disconnected from ESP valve block 340 and rotated aft. The flexible conductors 420 connected to the manifold block 410 permit rotation of the ESD Valve Block 340 and female receptacle 310. At this point, production is temporarily stopped and the disc brake 400 is released, allowing the BHRT 10 and female coupler 310 to unwind with respect to the vessel 30 by means of the rotatable coupling of the bearing 320. Upon reaching equilibrium, the brake 400 is reactivated, the manifold block 410 and pig launchers/pig receivers 390 are re-coupled to the ESD Valve Block, the ESD Valves are energized open and production is reinitiated.

FIG. 13 illustrates a cross-section of the manifold block 410, showing flow paths 430 and pigging paths 440. The flow paths 430 are in communication with the flexible conductors 420 and the pigging paths are in communication with the pig launchers/pig receivers 390.

FIG. 14 shows an alternative embodiment of FIG. 10 in which the pig launcher/pig receiver 390 is not installed at the top of the swivel 370. Rather, the ESD Valve Block 345 is modified to permit pig launching and receiving below the swivel 370 as illustrated in FIG. 7.

It should be understood that the invention is not limited to the exact details of construction, operation, or embodiments shown and described, as obvious modifications and equivalents will be apparent to one skilled in the art. For example, the tensile member 60 can be one member or a plurality of members and made of standard steel wires or other materials known to be mooring art for offshore vessels. The characteristics of the tensile member can vary depending on the dynamics of the system. Accordingly, the invention is therefore limited only by the scope of the claims.

What is claimed is:

1. A flexible buoyant and hybrid riser/tension member which is arranged and designed for coupling between a submerged structure to which a flow line extends and a floating body, said riser/tension member comprising, a flexible strength member capable of transferring mooring loads in tension along its length, at least one fluid flow conduit placed parallel with said strength member for conducing hydrocarbon between said submerged structure and said floating body, buoyancy material distributed along a length of said strength member and said fluid flow conduit, and an umbilical conduit placed parallel with said strength member of said fluid flow conduit.

2. The riser/tension member of claim 1 wherein, said buoyancy material is distributed along said strength member and said at least one conduit according to a predetermined pattern.

3. A flexible buoyant and hybrid riser/tension member which is arranged and designed for coupling between a submerged structure to which a flow line extends and a floating body, said riser/tension member comprising, a flexible strength member capable of transferring mooring loads in tension along its length, at least one fluid flow conduit placed parallel with said strength member for conducting hydrocarbon between said submerged structure and said floating body, buoyancy material distributed along a length of said strength member and said fluid flow conduit wherein, said at least one fluid flow conduit is a tubular shaped structure, with a cylindrical wall, and said strength member is said cylindrical wall of said conduit.

4. The riser/tension member of claim 3 further comprising, an umbilical flow path placed parallel with said fluid flow conduit.

5. The riser/tension member of claim 3 wherein, said strength member includes a plurality of flexible tubes, and said at least one fluid flow conduit is defined for each strength member by a fluid flow path extending through each tube.

6. A flexible buoyant and hybrid riser/tension member which is arranged and designed for coupling between a submerged structure to which a flow line extends and a floating body, said riser/tension member comprising, a flexible strength member capable of transferring mooring loads in tension along its length, at least one fluid flow conduit placed parallel with said strength member for conducting hydrocarbon between said submerged structure and said floating body, buoyancy material distributed along a length of said strength member and said fluid flow conduit, said strength member includes a plurality of flexible tubes, said at least one fluid flow conduit is defined for each strength member by a fluid flow path extending through each tube, and an umbilical conduit is placed parallel with said strength member and said conduit.

7. The riser/tension member of claim 6 wherein, said strength member is a flexible tension member.

8. A flexible buoyant and hybrid riser/tension member which is arranged and designed for coupling between a submerged structure to which a flow line extends and a floating body, said riser/tension member comprising, a flexible strength member capable of transferring mooring loads in tension along its length, at least one fluid flow conduit placed parallel with said strength member for conducting hydrocarbon between said submerged structure and floating body, buoyancy material distributed along a length of said strength member and said fluid flow conduit, wherein said strength member is flexible tension member, said tension member is a cable of stranded steel wires.

9. A flexible buoyant and hybrid riser/tension member which is arranged and designed for coupling between a submerged structure to which a flow line extends and a floating body, said riser/tension member comprising, a flexible strength member capable of transferring mooring loads in tension along its length, at least one fluid flow conduit placed parallel with said strength member for conducting hydrocarbon between said submerged structure and said floating body, and buoyancy material distributed along a length of said strength member and said fluid flow conduit, wherein, said buoyancy material is placed continuously along substantially an entire length of said strength member and said conduit.

10. The riser/tension member of claim 9 wherein, said buoyancy material surrounds said strength member and said conduit for a length of said riser/tension member.

11. A flexible buoyant and hybrid riser/tension member which is arranged and designed for coupling between a submerged structure to which a flow line extends and a floating body, said riser/tension member comprising, a flexible strength member capable of transferring mooring loads in tension along its length, at least one fluid flow conduit placed parallel with said strength member for conducting hydrocarbon between said submerged structure and said floating body, buoyancy material distributed along a length of said strength member and said fluid flow conduit, wherein, said strength member, said at least one conduit, and said buoyancy material are integrally constructed.

12. The riser/tension member of claim 11 further comprising, an umbilical conduit placed parallel with said strength member and said conduit.

13. A flexible buoyant and hybrid riser/tension member which is arranged and designed for coupling between a submerged structure to which a flow line extends and a floating body, said riser/tension member comprising, a flexible strength member capable of transferring mooring loads in tension along its length, at least one fluid flow conduit placed parallel with said strength member for conducting hydrocarbon between said submerged structure and said floating body, buoyancy material distributed along a length of said strength member and said fluid flow conduit, wherein, said strength member and said at least one conduit are constructed to define an integral member, and lengths of said buoyancy material are attached at spaced locations along said integral member.

14. The riser/tension member of claim 13 further comprising, an umbilical conduit formed integrally with said integral member.

15. A flexible buoyant and hybrid riser/tension member which is arranged and designed for coupling between a submerged structure to which a flow line extends and a floating buoy, said riser/tension member comprising, a flexible strength member capable of transferring mooring loads in tension along its length, at least one fluid flow conduit placed parallel with said strength member for conducting hydrocarbon between said submerged structure and said floating body, buoyancy material distributed along a length of said strength member and said fluid flow conduit, wherein said buoyancy material surrounds said strength member and said conduit for a length of said riser/tension member, and an umbilical conduit is placed parallel with said strength member and said conduit.

16. A flexible buoyant and hybrid riser/tension member which is arranged and designed for coupling between a submerged structure to which a flow line extends and a floating body, said riser/tension member comprising, a flexible strength member capable of transferring mooring loads in tension along its length, at least one fluid flow conduit placed parallel with said strength member for conducting hydrocarbon between said submerged structure and floating body, buoyancy material distributed along a length of said strength member and said fluid flow conduit, wherein, said strength member is a chain.

17. A mooring and fluid transfer system comprising, a floating body having a first coupling mounted thereon, a riser/tension member having a length with a lower end and an upper end, and having, a tension member capable of transferring mooring loads along said length, at least one fluid flow conduit integral with and placed parallel with said strength member and arranged and designed to conduct hydrocarbons from said lower end to said upper end, and buoyancy material distributed axially along said strength member and said fluid flow conduit, and a second coupling secured to said upper end, a submerged structure secured to said sea floor and having a flow line extending to said submerged structure with said strength member secured to said submerged structure and with said fluid flow conduit fluidly coupled to said flow line at said submerged structure, wherein said second coupling of said riser/tension member and said first coupling mounted on said floating body are cooperatively designed so that when said second coupling is pulled into coupling engagement with said first coupling, and said floating body is moored to said submerged structure via said tension member of said riser/tension member, said floating body is fluidly coupled to said flow line at said submerged structure via said fluid flow conduit of said riser/tension member.

18. The mooring and fluid transfer system of claim 17 wherein, said first coupling of said floating member is a female coupling, and said second coupling of said riser/tension member is a male coupling.

19. The mooring and fluid transfer system of claim 18 wherein, said female coupling is mounted on a deck of said floating body.

20. The mooring and fluid transfer system of claim 18 wherein, said female coupling is mounted in a hull section of said floating body above water level.

21. The mooring and fluid transfer system of claim 18 further comprising, a pull-in line extending through said female coupling, a securing means on said pull-in line for securing said pull-in line to said male coupling of said riser/tension member, and which means operatively connected to said pull-in line for pulling said male coupling of said riser/tension member into said female coupling of said floating body.

22. The mooring and fluid transfer system of claim 17 wherein, said second coupling of said riser/tension member and said first coupling mounted on said floating body are cooperatively arranged and designed for selective connection or disconnection, whereby when said first and second couplings are connected together, said floating body is capable of weathervaning about said submerged structure while being tethered by said riser/tension member and hydrocarbon transfer is capable between said pipeline at said submerged structure and said floating body via said fluid flow conduit, and whereby when said first and second couplings are disconnected, said floating body is free to move away from said submerged structure.

23. The mooring and fluid transfer system of claim 17 wherein, said strength member passes through and is coupled to a flexible torque shaft, with said strength member secured to said submerged structure whereby said flexible torque shaft enables said riser/tension member to move angularly from a vertical axis at the flow line end manifold but prevent angular twisting of said riser/tension member about its longitudinal axis at said submerged structure.

24. The mooring and fluid transfer system of claim 23 wherein, said strength member is stranded steel wire cable.

25. The mooring and fluid transfer system of claim 24 wherein, said at least one fluid conduit path includes at least two tubular conduits which are fluidly coupled to said flow line at said submerged structure.

26. The mooring and fluid transfer system of claim 25 wherein, said at least two tubular conduits are splayed outwardly via bend stiffeners at said submerged structure to permit localized flexing of said conduits near coupling of said conduits to said pipeline at said submerged structure.

27. The mooring and fluid transfer systems of claim 17 wherein, said second coupling secured to said upper end of said riser/tension member includes a riser end buoy which is arranged and designed for selective connection or disconnection with said first coupling mounted on said floating body.

28. The mooring and fluid transfer system of claim 17 wherein, said riser/tension member at said upper end includes a riser end housing where said tension member extends through and couples with an upper flexible torque shaft which is flexible in bending but rigid in torsion, said at least one fluid flow conduit includes at least one tubular conduit which is fluidly coupled to said flow line at said submerged structure, and a riser end buoy is structurally coupled to said tension member and said upper flexible torque shaft, and is fluidly coupled to said at least one tubular conduit at said upper end of said riser/tension member.

29. The mooring and fluid transfer system to claim 28 wherein, said floating body includes a coupling arranged and designed for selective connection of said riser end buoy to said floating body, whereby, said floating body is moored to said submerged structure via said tension member of said riser/tension member and fluid communication between said flow line at said submerged structure and said floating body is established via said at least one tubular conduit.

30. The mooring and fluid transfer system of claim 29 wherein, said coupling of said floating body is a female coupling arranged and designed for coupling with said riser end buoy at said upper end of said riser/tension member.

31. The mooring and fluid transfer system of claim 30 wherein, said female coupling is mounted on said floating body by a bearing assembly whereby, said floating body rotates with respect to said female coupling and said riser end buoy when said floating body weathervanes with respect to said submerged body.

32. The mooring and fluid transfer system of claim 30 wherein, said female coupling is mounted on said floating body on gimbals.

33. The mooring and fluid transfer system of claim 29 wherein, said floating body includes a fluid swivel which provides rotative fluid coupling between said at least one tubular conduit of said riser/tension member and a corresponding conduit leading to a vessel storage hold.

34. The mooring and fluid transfer system of claim 33 further comprising, a valve block fluidly communicating between said at least one tubular conduit of said riser/tension member and said fluid swivel.

35. The mooring and fluid transfer system of claim 29 wherein, said floating body includes a manifold block between said at least one tubular conduit of said riser/tension member and a corresponding conduit leading to a vessel storage hold.

36. The mooring and fluid transfer system of claim 35 wherein, a valve block fluidly communicates between said at least one tubular conduit of said riser/tension member and said manifold block.

37. The mooring and fluid transfer system of claim 35 wherein, said coupling of said floating body includes a female receptacle mounted on a bearing assembly with respect to said floating body, said female receptacle providing coupling with said riser end buoy, a brake is mounted for selective applications between said female receptacle and said floating body for selective prevention of rotation of said female receptacle, whereby where said brake is applied to said female receptacle and as the floating body rotates by weathervaning forces about said pipeline end manifold, said riser/tension member winds up with said valve block and said manifold block and when said brake is not applied to said female receptacle, said riser/tension member is allowed to unwind.

38. A flexible buoyant hybrid riser/tension member which is arranged and designed for coupling between a subsea structure to which to a pipeline extends and a vessel, said riser/tension member including, at least one fluid flow tubular conduit having walls and space between said walls and a length arranged for conducting hydrocarbons through said space between said pipeline of said first body and said vessel and with said walls of said tubular conduit providing a tension member between said vessel and said subsea structure, said tubular conduit having buoyancy material provided at least partially along said length of said conduit, whereby said tubular conduit serves simultaneously to conduct hydrocarbons from said pipeline of said first body and to provide a securing mooring line to said vessel with respect to said first submerged body.

39. The hybrid riser/tension member of claim 38 wherein, said first body is a pipeline end manifold which is secured to a sea floor.

40. The hybrid/tension member of claim 38 wherein, said subsea structure is a tower.

41. The hybrid/tension member of claim 38 wherein, said subsea structure is a submerged TLP structure.

42. The hybrid/tension member of claim 38 wherein, said subsea structure is a submerged buoy.

43. The hybrid/tension member of claim 38 further comprising, a strength tension member disposed along said length of said tubular conduit.

44. The hybrid/tension member of claim 43 further comprising, at least one additional tubular conduit along said length for conducting hydrocarbon between said pipeline of said first body to said vessel.

45. The hybrid/tension member of claim 43 further comprising, an umbilical disposed along said length of said tubular conduit for conducting pressurized control fluid from said vessel to said subsea structure.

46. A mooring and fluid transfer system comprising a vessel having a storage hold disposed thereon, a riser/tension member having a length with a lower end and an upper end, said riser/tension member including a tension member capable of transferring mooring loads along said length, at least one fluid flow conduit integrated with and disposed parallel with said strength member and designed to conduct hydrocarbons from said lower end to said upper end, and buoyancy material distributed axially along said strength member and said fluid flow conduit, a submerged structure secured to said sea floor and having a flow line extending to said submerged structure with said strength member secured to said submerged structure and with said fluid flow conduit fluidly coupled to said flow line at said submerged structure, a hawser line connected between said vessel and said upper end of said riser/tension member to said tension member, and at least one fluid flow line fluidly coupled between said storage hold of said vessel and said upper end of said riser/tension member to said at least one fluid flow conduit, whereby, said vessel is moored to said submerged structure via said hawser and said tension member of said riser/tension member, and said vessel storage hold is fluidly coupled to said flow line at said submerged structure via said fluid flow line and said fluid flow conduit of said riser/tension member.

47. An offshore arrangement comprising, a submerged structure positioned in proximity to a floating vessel and having a flow line supported by said structure, a riser/tension member having a length with a lower end and an upper end and having, with a tension member capable of transferring mooring loads along said length, at least one fluid flow conduit integral with and placed parallel with said strength member and arranged and designed to conduct hydrocarbons from said lower end to said upper end, and buoyancy material distributed axially along said strength member and said fluid flow conduit, and a second coupling secured to said upper end, said tension member secured to said submerged structure at said lower end, said at least one fluid flow conduit fluidly coupled to said flow line at said lower end, and said vessel being connected to said tension member and fluidly coupled to said at least one fluid flow conduit at said upper end of said riser/tension member.

48. The arrangement of claim 47 wherein, a load bearing swivel couples said riser/tension member to said vessel.

49. The arrangement of claim 47 wherein, a load bearing swivel is placed on a floating body and couples said upper end of said riser/tension member to said vessel.

50. The arrangement of claim 49 wherein, a hawser is connected between said vessel and said tension member via said swivel, and at least one flow line is connected between said vessel and said at least one fluid flow conduit via said swivel.

51. The arrangement of claim 47 wherein, said submerged structure is a submerged buoy.

52. The arrangement of claim 51 wherein, said flow line and said at least one fluid flow conduit are fluidly connected by a jumper hose, and said flow line is supported by a tension member from said submerged buoy.

* * * * *

UNITED STATES PATENT AND TRADEMARK OFFICE

CERTIFICATE OF CORRECTION

PATENT NO. : 6,688,930 B2
DATED : February 10, 2004
INVENTOR(S) : Roy H. Cottrell and Martin Duensing It is certified that error appears in the above-identified patent and that said Letters Patent is hereby corrected as shown below:

Column 13,
Line 13, delete “which” and insert -- winch --

Signed and Sealed this

Twentieth Day of July, 2004

JON W. DUDAS
*Acting Director of the United States Patent and Trademark Office*